US008256637B2

(12) United States Patent
Goodman et al.

(10) Patent No.: US 8,256,637 B2
(45) Date of Patent: Sep. 4, 2012

(54) WIRE FORMED PRODUCTS

(75) Inventors: Sheldon H. Goodman, Solon, OH (US); Omer I. Sazir, Cleveland, OH (US); Elizabeth A. Cho, Strongsville, OH (US)

(73) Assignee: Spectrum Diversified Designs, Inc., Streetsboro, OH (US)

( * ) Notice: Subject to any disclaimer, the term of this patent is extended or adjusted under 35 U.S.C. 154(b) by 153 days.

(21) Appl. No.: 12/856,597

(22) Filed: Aug. 14, 2010

(65) Prior Publication Data

US 2012/0037648 A1 Feb. 16, 2012

(51) Int. Cl.
*B65D 6/08* (2006.01)

(52) U.S. Cl. ..... 220/491

(58) Field of Classification Search ..... 220/485, 220/487, 489, 491, 492, 494, 495; 256/32, 256/33; 248/153; 211/181.1; 47/44; 52/660, 52/647, 656.8

See application file for complete search history.

(56) References Cited

U.S. PATENT DOCUMENTS

| | | | | | |
|---|---|---|---|---|---|
| 805,764 | A | * | 11/1905 | Wheelock et al. | 256/37 |
| 1,142,233 | A | * | 6/1915 | Bryning | 256/33 |
| 2,667,335 | A | * | 1/1954 | Lewis | 256/33 |
| 2,675,289 | A | * | 4/1954 | Whitmore | 312/213 |
| 2,920,900 | A | * | 1/1960 | Best | 280/652 |
| 2,923,415 | A | * | 2/1960 | Brown | 211/65 |
| 3,395,810 | A | * | 8/1968 | Johnson | 220/491 |
| 4,372,351 | A | * | 2/1983 | Myers | 140/112 |

* cited by examiner

*Primary Examiner* — Harry Grosso
(74) *Attorney, Agent, or Firm* — Pearne & Gordon LLP

(57) ABSTRACT

Wire formed products are formed of wires of various cross-sectional shapes and sizes shaped and assembled to form containers, holders, dispensers and the like for household and office use. In preferred arrangements, the wire formed product comprises a weldment of frame and connecting wires. The connecting wires form arches that each include an arcuate end extending to spaced legs that overlap with the legs of adjacent wires.

21 Claims, 5 Drawing Sheets

WIRE FORMED PRODUCTS

BACKGROUND OF THE INVENTION AND RELATED ART

This invention relates to wire formed products wherein wire of various cross-sectional shapes and sizes are shaped and assembled to form containers, holders, dispensers and the like for household and office use. In preferred arrangements, the wire formed products are weldments of a plurality of wires having selected cross-sectional shapes and sizes. Optionally, the wire formed product may include a non-wire member or element.

In such wire formed products, it is often necessary to form planar and/or non-planar expanses or regions such as walls or supports. One or more of such walls or supports may be incorporated in the more comprehensive structure of the wire formed product. For convenience herein, such an expanse or region is described with reference to a wall.

The wall may be formed as an assembly of frame and connecting wire portions secured together by welding. The wall will typically include at least two edges that define the plane of the wall with the connecting wires extending therebetween. The wall may have uniform or varying dimensions such that opposed wall edges may be generally parallel, or one or both, may be inclined or arcuate.

The opposed wall edges are typically formed, at least in part, by a frame wire that is more rigid than the connecting wire. The frame wire forms at least one wall edge and defines the intended wall shape. It is desirable during manufacture and in the final wire formed product that the connecting wire portions are aligned with the frame wire and secured thereto in the plane of the wall.

The connecting wires extend from the frame wire wall edge to an opposed wall edge. Again, it is desirable that the connecting wires extend in the plane between the opposed wall edges. Further, the wires should be arranged in a pattern that accommodates different and varying wall dimensions while allowing for interconnection to assure sufficient wall strength.

SUMMARY OF THE INVENTION

In accordance with the invention, wire formed products include a wall having a wall edge formed by a frame wire secured to a plurality of connecting wires. The connecting wires have arch-shapes including an arcuate end connecting spaced legs that extend to an opposed wall edge along a wall perimeter portion remote of the frame wire.

The arcuate ends of the connecting wires are secured to the frame wire at spaced locations along the frame wire wall edge and the arch-shape connecting wires extend in an array within the plane defined by the frame wire wall edge and the opposed wall edge. The plane of the wall may be flat or curved.

The array of arch-shape connecting wires are spaced and configured so that adjacent legs overlap at an intermediate point between the frame edge and the opposed wall edge. The connecting wire portions are welded together at the intermediate points.

The opposed wall edge remote of the frame wire may be a second frame wire or an extension of the first frame wire. For example, the frame wire may extend around and form the entire perimeter of the wall and all of the wall edges. The opposed wall edge may comprise a non-wire member such as a perforated or continuous metal or wood wall element.

In some arrangements, the opposed wall edge may be provided by bending or otherwise angularly offsetting the connecting wires at a location remote of the frame wire edge to form an integral wall edge along at least a portion of the wall perimeter. Adjacent connecting wires may be bent along a straight or curved line to form the integral wall edge.

For example, an integral wall edge may be provided by connecting wire portions that are bent or otherwise deformed at a wall perimeter portion and extend to a remote portion of the wire formed product for support. The extending connecting wires may form one or more additional walls prior to attachment to a frame wire or other support element.

The connecting wires forming the wall may be shaped and extended to provide a joined wall that is supported in a remote part of the wire formed product. In preferred arrangements, the connecting wires are configured to form one or more joined walls which provide a subassembly of the wire formed product.

For example, the frame wire may be shaped into a frame wire channel pattern or subassembly having a U-shape cross-section and a configuration corresponding with the outline of a short channel including opposed sidewalls joined by a connecting wall. The frame wire channel pattern may be formed by a single piece of frame wire joined at its ends or a plurality of pieces of frame wire joined together. In this arrangement, the connecting wires may be bent in a saddle-shape or a U-shape pattern with the legs of the "U" cooperating with the frame wire to form opposed sidewalls of the wire formed product and the bight of the "U" cooperating with the frame wire to form a connecting wall of the wire formed product.

Further, a second frame wire channel pattern or subassembly may be mounted cross-wise to the first frame wire channel pattern with the bight portions of the subassemblies overlying each other and the leg portions providing four walls of a container shaped product. The second frame wire channel pattern may be formed without a connecting wall and the arch leg ends may be fixed to the first frame wire subassembly.

The wire formed products are rigid in that they may not be deformed and then returned to their starting configuration. That is, the wire elements are welded together and maintained in a fixed pattern by the combined strength and rigidity of the wire elements and their weldment arrangement.

DETAILED DESCRIPTION OF THE DRAWINGS

Figure 1:
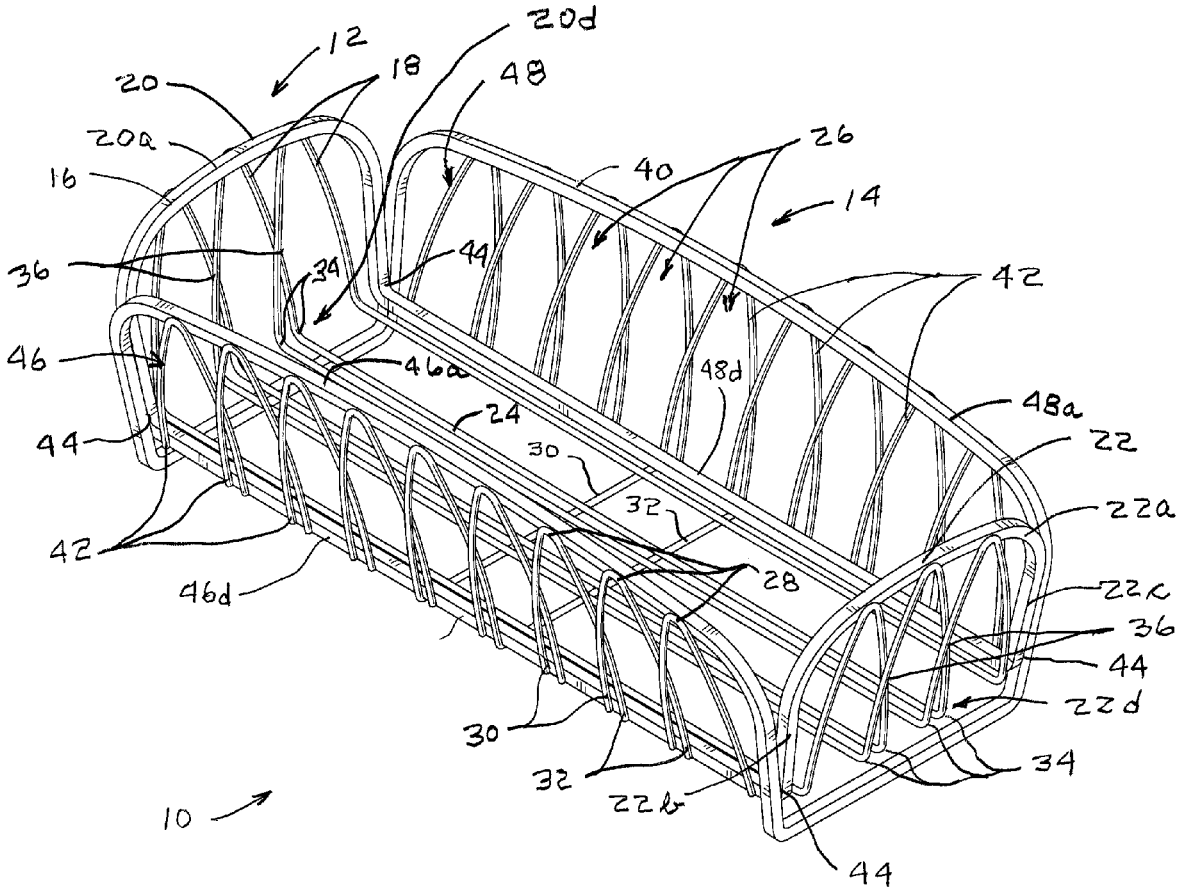
FIG. 1 is a perspective view of a bread basket in accordance with the invention.
Figure 2:
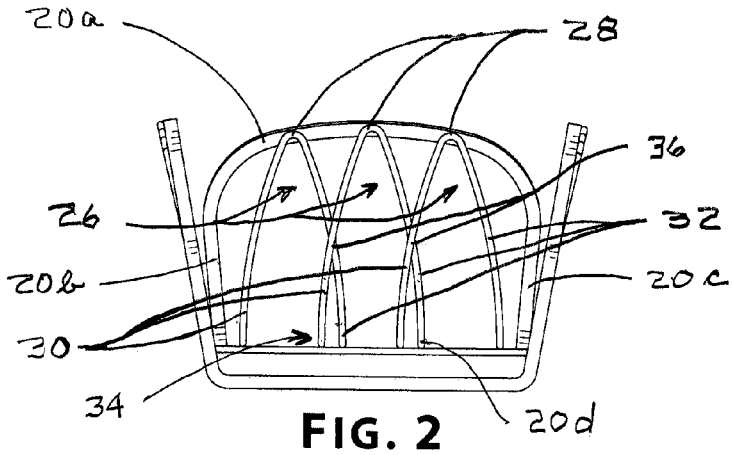
FIG. 2 is a side elevational view of the bread basket of FIG. 1.
Figure 3:
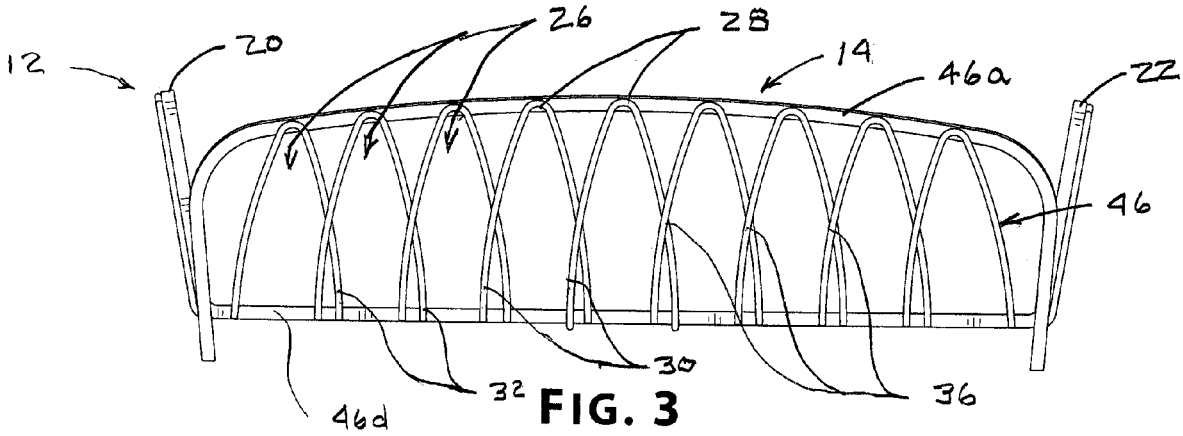
FIG. 3 is a front elevational view of the bread basket of FIG. 1.

Referring to FIGS. 1, 2 and 3, a bread basket 10 is formed as a weldment of inter-fitted subassemblies 12 and 14. Each of the subassemblies 12, 14 has a saddle or U-shape.

The subassembly 12 includes a frame wire 16 extending continuously along the perimeter of the subassembly. Connecting wires 18 are secured to the frame wire 16 and cooperatively form opposed side or end walls 20 and 22 joined by a bottom wall 24. Each of the walls comprises an array of connecting wires 18 extending in the plane of the wall.

Connecting wires 18 forming the subassembly 12 are similarly shaped. Each connecting wire 18 includes an arch 26 (FIG. 2) comprising an arcuate end 28 extending to spaced legs 30 and 32. As shown, the arches 26 are of different heights in accordance with the arcuate perimeter of the wall edges. Each arch 26 is formed with a relatively small radius arcuate end 28 extending to associated spaced legs 30 and 32. The arch 26 is symmetrical about an axis passing between the legs 30, 32 and intersecting the midpoint of the arcuate end 28.

The radius of the arcuate end 28 of the arch 26 is typically much smaller than the distance between the spaced legs 30, 32 or arch base size at the remote wall edge. For example, the ratio of the arcuate end radius to the arch base or distance between the spaced legs at the remote wall edge may be about 1:2 to about 1:24. In the basket 10, the ratio is about 1:15. The radius of the arcuate end of the arch may range from about ⅛" to about ½" or more.

The arches 26 are arranged in a planar array within the associated end wall 20 or 22. Each of the end walls, 20, 22 has an upper wall edge 20*a*, 22*a* defined by an upper portion of the frame wire 16 and opposed side edges 20*b*, 20*c* and 22*b*, 22*c* defined by adjacent side portions of the frame wire 16. Each of the walls 20, 22 also has a lower wall edge or integral wall edge 20*d*, 22*d* formed by aligned bends 34 in the connecting wires 18 as described below.

The arches 26 are connected to the adjacent upper portion of the frame wire 16 by spot welding the arcuate ends 28 to the frame wire at spaced locations along the wall edge 20*a*, 22*a*. The single point weld or connection to the frame wire 16 facilitates assembly and assures that the arches 26 are properly positioned within a planar array in the end wall.

In part, the heavier gauge of the frame wire 16 is more rigid and resistant to improper deformation once it is initially shaped. The wire may have any cross-sectional shape, but it is preferred to provide the cross-section with at least one generally flat surface to facilitate positioning and welding of the connecting wires 18 to the frame wire.

Typical frame wire gauge is in the range of from about ⅙" to about ¼" (4 mm to 6 mm). Alignment is also assisted by the flat weld or attachment wall surface provided by the rectangular cross-section of the frame wire 16. This allows the arcuate end 28 to be positioned with pressure against the flat surface of the frame wire 16 during welding.

The spaced legs 30 and 32 extend from the arcuate end 28 of each arch 26. As viewed from the outside of the basket 10, each arch 26 includes a left leg 30 and a right leg 32 as best shown in FIG. 2.

In this embodiment, the arch 26 is provided with a bullet-shape profile characterized by the legs initially extending from the arcuate end along a compound curve. The adjacent legs are positioned to overlap at intermediate points 36 between the arcuate end 28 and aligned bends 34 in the spaced legs 30, 32.

The arch pattern enables the legs 30, 32 to be spaced apart greater or lesser distances to accommodate different wall height and width dimensions while maintaining a uniform wall construction. The arch height to width ratio may vary in accordance with the particular product and/or wall size. For example, the arch height to width ratio may range from about 1:1 to about 1:4.

Each pair of adjacent legs 30, 32 are spot welded together at the intermediate point 36. In each pair of adjacent arches, the left leg of one arch overlies or is on the outer side relative to the basket 10 of the right leg of the adjacent arch. Here, the left legs 30 overlie the right legs 32.

The spaced legs 30, 32 extend to a substantially parallel relationship adjacent the bends 34 and beyond. The connecting wires 18 extend from the bends 34 at the lower or integral wall edges 20*d* and 22*d* toward the remote end wall 20 or 22 and cooperate to form the bottom wall 24 of the basket 10.

Accordingly, the connecting wires 18 are formed with a U-shape corresponding with that of the subassembly 12. Similarly, the frame wire 16 extends along the perimeter of the connecting wires 18 and has a similar U-shape including leg portions surrounding the end walls 20, 22 and bight portions surrounding the bottom wall 24. The frame wire 16 and the connecting wires 18 are provided with a similar obtuse angular shape relative to the bottom wall 24 so that the walls 20, 22 slope outwardly from the bottom wall 24 of the basket 10.

The subassembly 14 includes a frame wire 40 extending continuously along its perimeter and a plurality of connecting wires 42. The subassembly 14 is mounted cross-wise in the subassembly 12, and the frame wires 16 and 40 are welded together at engagement points 44 at each of the corners of the basket 10 as shown in FIG. 1.

The connecting wires 42 are secured to the frame wire 40 and cooperatively form a front wall 46 and a back wall 48 of the basket 10. The connecting wires 42 extend in the plane of the wall between the frame wire 40 and an adjacent bight portion of the frame wire 16. The frame wire 40 and the connecting wires 42 are provided with a similar obtuse angular shape so that the walls 46 and 48 slope outwardly from the bottom wall 24 of the basket 10. As shown, the angular shapes and the slopes of the walls 20, 22 and 46, 48 are similar.

Each of the connecting wires 42 has an arch shape 26 and includes an arcuate end 28 that is spot welded to the portion of the frame wire 42 respectively extending along top edge 46*a* of the front wall 46 and top edge 48*a* of the back wall 48. Except for the arches 26 positioned at the midpoints of the walls, the spaced legs 30 and 32 of the arches 26 terminate at the bottom wall edges 46*d* and 48*d*, where they are spot welded to the adjacent bight portion of the frame 16. The spaced legs 30, 32 of the arches 26 located at the midpoints of the walls 46, 48 are bent around the adjacent bight portion of the frame wire 16 and joined to provide additional structural reinforcement.

The frame wires 16 and 40 may have round or non-round cross-sections, a rectangular cross-section being illustrated herein. The frame wires are typically formed of heavier gauge wire than the connecting wire, typically a wire major cross dimension should be in the range of from about 4 mm to about 6 mm. The frame wire may be formed of steel or a similar metal that is shapeable by bending.

The frame wires 16 and 40 may each be formed as a single U-shape assembly using the technique described below in connection with FIG. 4. More preferably, it is formed of a single wire having its end welded together and thereafter deformed to the desired U-shape.

Figure 4:
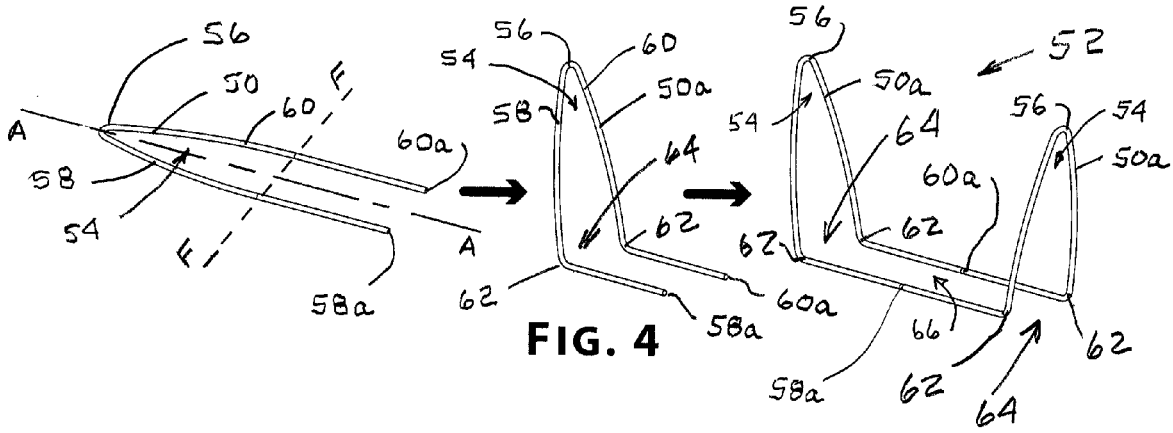
FIG. 4 is a schematic view showing sequential steps for forming a connecting wire into a U-shape assembly including a pair of opposed arches joined by the spaced legs.

Referring to FIG. 4, sequential steps useful for forming a connecting wire 50 into a U-shape assembly 52 are schematically shown. The assembly 52 may be incorporated in a wire formed product of the invention. The wire 50 may have a round or non-round cross-section, and it may range in diameter or major dimension from about 1/16" to about 1/8" (1.5 mm to 3.5 mm). The wire may be formed of steel or a similar metal that is shapeable by bending. The wire may have a powder coating, a wet painted coating, a plastic coating or a plated finish.

The wire 50 is initially bent to provide an arch 54 including an arcuate end 56 extending to a pair of spaced legs 58, 60. The arch 54 is symmetrical about an axis "A" passing between the legs 58, 60 and intersecting the midpoint of the arcuate end 56. The wire 54 corresponds with the wire 18, and the arch 54 with the arch 26 as described above in connection with FIGS. 1-3.

The legs 58, 60 are bent in an obtuse angle in excess of 90°, e.g., 110°, to form bends 62 and an integral edge 64 of a wall formed by the arch 54 and to provide the wall with an outward slope relative to the basket. In this instance, the bends 62 will be formed at the line F-F as shown in the left-hand view of FIG. 4.

The bent wire 50*a* is shown in the middle view of FIG. 4. The spaced legs 58, 60 are disposed in substantially parallel relationship at the edge 64 and beyond to their ends 58*a* and 60*a*. Accordingly, a pair of wires 50*a* may be joined by butt welding the ends 58*a*, 60*a* of their legs 58, 60 to form the U-shape assembly 52 as shown at the right in FIG. 4. The legs 58, 60 form a connecting wall 66 joining the arches 54. The assembly 52 may be incorporated in a more comprehensive wire formed product or it may be formed as its components are welded to a frame wire.

Figure 5:
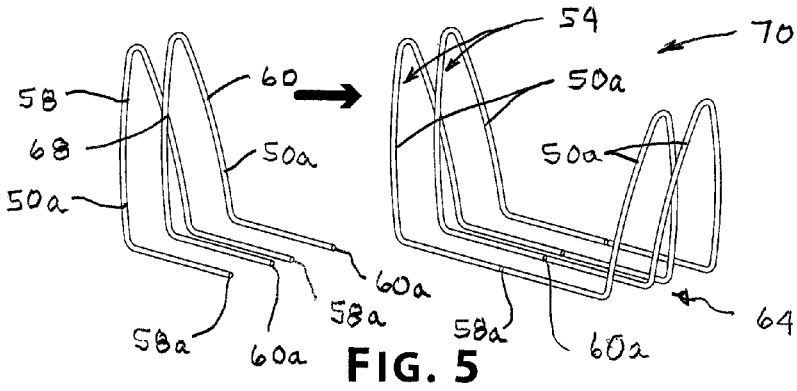
FIG. 5 is a schematic view showing sequential steps for forming a U-shape assembly of a pair of connecting wires with their adjacent legs overlying and welded together at an intermediate point between the arch arcuate end and the integral wall edge, and having their extended legs forming a connecting wall for the arches.

Referring to FIG. 5, a pair of bent wires 50*a* is shown on the left side of the view with their adjacent legs 58 and 60 overlying or crossing at an intermediate point 68. The legs may be welded together at 68 in an initial fabrication step. With or without prior welding, the pair of legs may be assembled with a similar pair of bent wires 50*a* as shown in the right hand view of FIG. 5. The leg ends 58*a*, 60*a* may be butt welded together and welds may also be provided at the intermediate points 68, if not previously welded. The resulting assembly 70 shown at the right hand side of FIG. 5 may be incorporated in a more comprehensive wire formed product or it may be formed as its components are welded to a frame wire.

Figure 6:
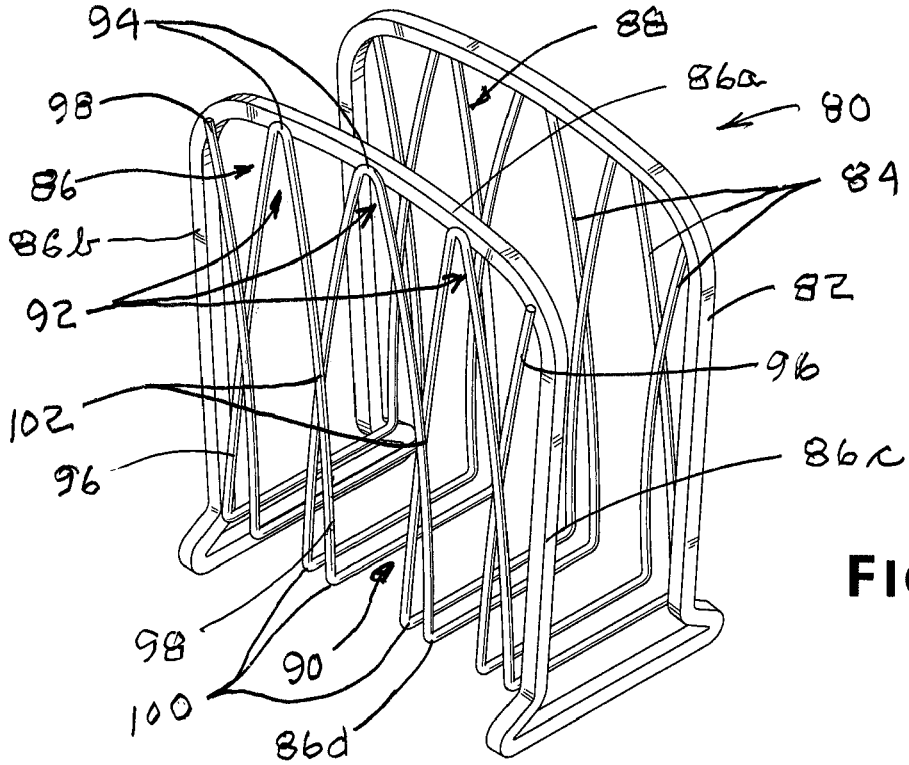
FIG. 6 is a perspective view of a napkin holder in accordance with the invention.

Referring to FIG. 6, a napkin holder 80 comprising a weldment of a frame wire 82 and connecting wires 84 is shown. The frame wire 82 is continuous and is arranged in a U-shape or saddle pattern. Connecting wires 84 are mounted to the frame wire 82 and cooperatively form opposed planar walls 86 and 88 that are connected by a bottom wall 90.

The connecting wires 84 are shaped to provide arches 92 including arcuate ends 94 extending to spaced legs 96 and 98. Each of the arches 92 is symmetrical about an axis passing through the midpoint of the arcuate end 94 and extending between the spaced legs 96 and 98.

The walls 86 and 88 are identical and, for convenience, only the wall 86 is described in detail. The arches 92 are arranged in a planar array within wall 86. The wall 86 has an upper wall edge 86*a* provided by an upper portion of the frame wire 82 and opposed side edges 86*b* and 86*c* formed by adjacent side portions of the frame wire 82. The wall 86 has a bottom or lower edge 86*d* that is integrally formed by aligned bends 100 in the connecting wires 84. The bends 100 are substantially right angle bends and the opposed walls 86 and 88 are parallel.

The adjacent legs 96, 98 are positioned to overlap at intermediate points 102 between the upper wall edge 86*a* and the lower wall edge 86*d*. The legs are spot welded together at the intermediate points 102.

In this embodiment, a single arch leg 96 or 98 is provided at each side extremity of the planar array of arches forming the wall 86. The single arch leg 96 or 98 extends between the opposed walls 86 and 88.

As compared to the arches 26, the arches 92 are elongated and the intermediate points 102 are closer to the upper wall edge 86*a* than to the bottom wall edge 86*d*. The elongation of the arches 92 accommodates the increased height to width ratio of the dimensions of the wall 86 as compared with the height to width ratios of the walls 20, 22 and 46, 48.

Figure 7:
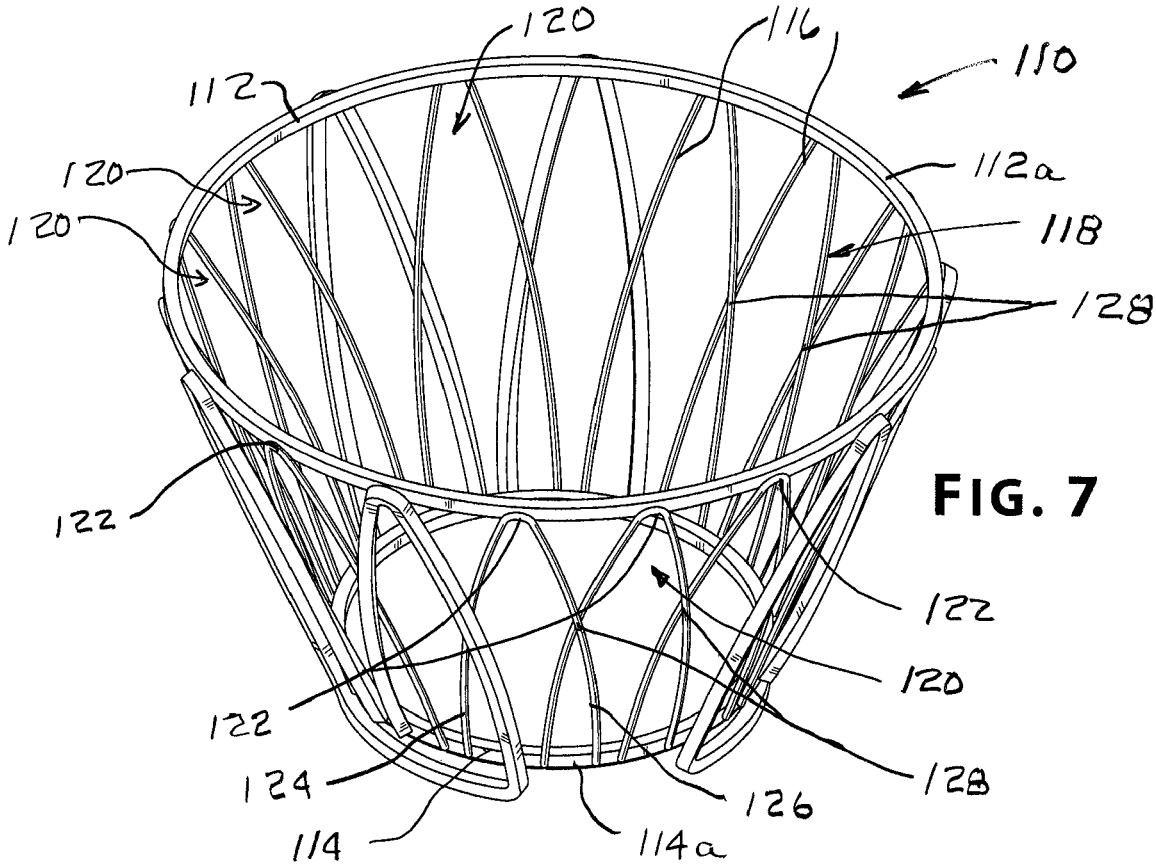
FIG. 7 is a perspective view of a bowl holder in accordance with the invention.

Referring to FIG. 7, a bowl 110 in accordance with the present invention is shown. The bowl 110 has a generally conical shape. The bowl 110 includes an upper frame wire 112 and a lower frame wire 114 joined by connecting wires 116. The frame wires 112 and 114 each have a circular shape.

The connecting wires 116 form a continuous wall 118 having a conical frustum shape. The wall 118 extends between an upper wall edge 112*a* and a lower wall edge 114*a* provided by the frame wires 112 and 114.

The connecting wires 116 comprise a plurality of overlapping arches 120 including arcuate ends 122 extending to spaced legs 124 and 126. Each of the arches 120 is symmetrical about an axis passing through the midpoint of the arcuate end 122 and extending between the spaced legs 124 and 126.

The arches 120 are positioned so that adjacent legs 124, 126 overlap at intermediate points 128 between the upper wall edge 112*a* and the lower wall edge 114*a*. The legs are spot welded together at the intermediate points 128.

A circular flat metal sheet forms a bottom wall 129 fixed to the lower edge 114*a*. The bottom wall 129 may be formed of a perforated metal mesh, a metal screen or a flat circular wood member.

Figure 8:
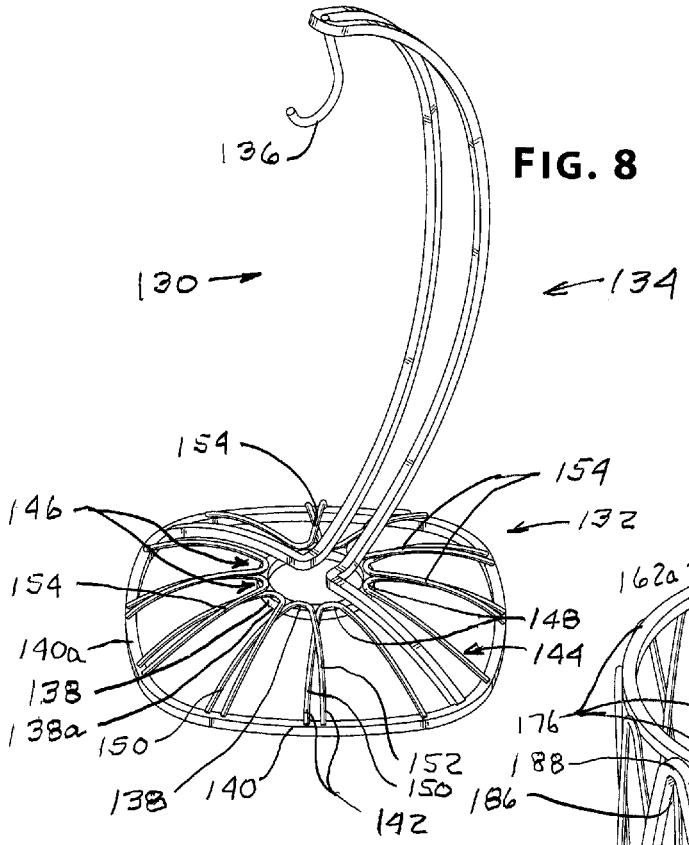
FIG. 8 is a perspective view of a banana holder in accordance with the invention.

Referring to FIG. 8, a banana holder 130 in accordance with the present invention is shown. The holder 130 has a truncated spherical shaped base 132 supporting an upstanding arm 134 extending to a hook 136 for supporting fruit.

The base 132 includes an upper frame wire 138 and a lower frame wire 140 joined by connecting wires 142. The frame wires 138 and 140 each have a circular shape.

The connecting wires 142 form a continuous wall 144 having a non-planar spherical zone shape. The wall 144 extends between an upper wall edge 138*a* and a lower wall edge 140*a* provided by the frame wires 138 and 140.

The connecting wires 142 comprise a plurality of overlapping arches 146 including arcuate ends 148 extending to spaced legs 150 and 152. Each of the arches 146 is symmetrical about an axis passing through the midpoint of the arcuate end 148 and extending between the spaced legs 150 and 152.

The arcuate ends 148 are welded to the upper frame wire 138 at the upper wall edge 138*a* and the lower extremities of the legs 150, 152 are welded to the frame wire 140 at the lower wall edge 140*a*.

The arches 146 are positioned so that adjacent legs 150, 152 overlap at intermediate points 154 between the upper wall edge 138*a* and the lower wall edge 140*a*. The legs are spot welded together at the intermediate points 154.

Figure 9:
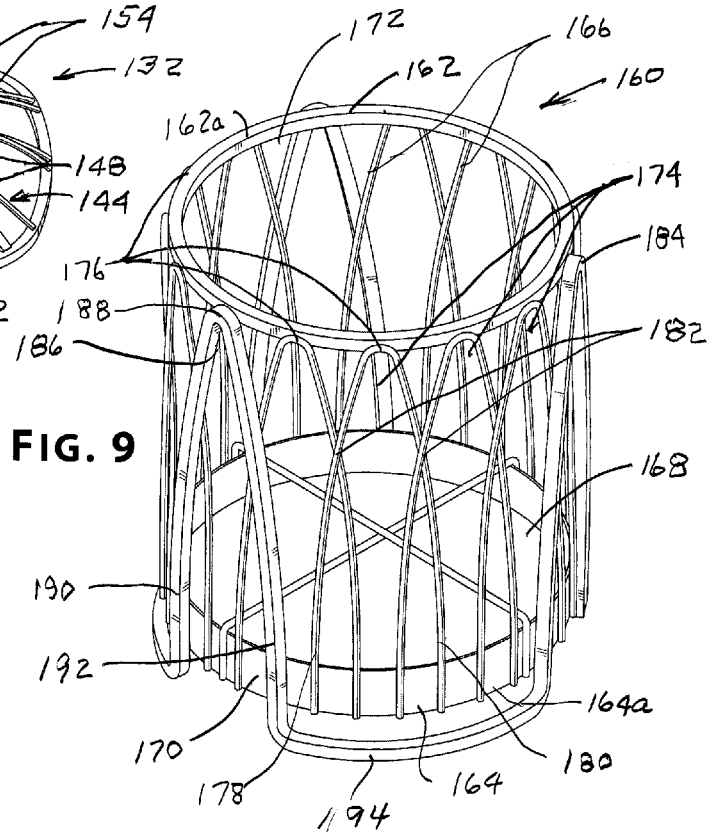
FIG. 9 is a perspective view of a utensil holder in accordance with the invention.

Referring to FIG. 9, a kitchen utensil holder 160 in accordance with the present invention is shown. The holder 160 has a cylindrical shape, an upper frame wire 162 and a lower metal base member 164 joined by connecting wires 166.

The upper frame wire 162 has a circular shape and the base member 164 has a cylindrical shape including a radial end wall 168 and an upstanding peripheral rim 170. The radial end wall and/or the peripheral rim 170 may be formed of sheet metal, perforated metal or wire grid.

The connecting wires 166 form a continuous wall 172 having a right cylindrical shape. The wall 172 extends between an upper wall edge 162*a* provided by the frame wire 162 and a lower wall edge 164*a* provided by the base member 164.

The connecting wires 166 comprise a plurality of overlapping arches 174 including arcuate ends 176 extending to spaced legs 178 and 180. Each of the arches 174 is symmetrical about an axis passing through the midpoint of the arcuate end 176 and extending between the spaced legs 178 and 180.

The arcuate ends 176 are welded to the upper frame wire 162 at the upper wall edge 162*a* and the lower extremities of the spaced legs 178, 180 are welded to the lower frame wire 164 at the lower wall edge 164*a*.

The arches 174 are positioned so that adjacent legs 170, 180 overlap at intermediate points 182 between the upper wall edge 162*a* and the lower wall edge 164*a*. The legs are spot welded together at the intermediate points 182.

In this embodiment, a frame arch member 184 formed of heavier gauge rectangular cross-section wire encircles the holder 160. The frame member 184 has a generally cylindrical shape including angularly spaced arches 186 extending from the upper frame wire 162 to the base member 164. Each arch 186 includes an arcuate end 188 connecting spaced legs 190 and 192. Each leg 190, 192 extends beyond the base member 164 to a lower frame leg 194 that connects adjacent arches 186.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. In a wire formed product comprising a weldment of one or more frame wires and connecting wires, said frame wire having a larger cross-sectional dimension than said connecting wire, the improvement comprising a wall including opposed first and second wall edges defining a wall plane, that may be flat or curved, having a plurality of said connecting wires extending between the edges within the wall plane, said connecting wires forming arches that each include an arcuate end connecting spaced legs, said arcuate ends of said connecting wires being welded to said frame wire at spaced locations along said first wall edge with said legs extending to said second wall edge, said connecting wires being arranged in an array within said wall plane with adjacent legs overlapping at an intermediate point between said arcuate end and said second wall edge, said adjacent legs being secured together at said intermediate point.

2. The improvement of claim 1, wherein said spaced legs include terminal portions remote of said intermediate points, said terminal portions of said legs being bent at an angle to said wall plane to form said second wall edge as an integral wall edge, said terminal portions extending from said integral wall edge to form a connecting wall extending in a connecting wall plane that intersects said wall plane.

3. The improvement of claim 2, wherein said wire formed product includes a remote wall opposed from said first mentioned wall, said remote wall including opposed first and second remote wall edges defining a remote wall plane having a plurality of said connecting wires extending between the remote wall edges within the remote wall plane, said connecting wires of said remote wall having the same configuration as said connecting wires of said first mentioned wall including a second integral wall edge with the terminal portions of the spaced legs extending to form said connecting wall.

4. The improvement of claim 1, wherein said second wall edge is formed by a member selected from the group consisting of a second frame wire, a remote portion of the first frame wire or a non-wire member that forms a part of said wire formed product.

5. The improvement of claim 1, wherein said wall has a shape selected from the group consisting of a planar shape, an arcuate shape, a conical frustum shape, a cylindrical shape and a non-planar spherical zone shape.

6. The wire formed product of claim 1, wherein said arch is generally symmetrical about an axis extending between said legs and passing through a midpoint of said arcuate end.

7. The wire formed product of claim 1, wherein said arch has a bullet-shape profile with said legs including compound curves and terminal leg portions that are substantially parallel.

8. The wire formed product of claim 1, wherein said frame wire has a cross-section including a flat surface extending along said first wall edge and said arcuate ends of said connecting wires are welded to said flat surface.

9. The wire formed product of claim 1, wherein said adjacent legs are welded together at said intermediate point.

10. The wire formed product of claim 1, wherein said arch has a height and a base width corresponding with the distance said connecting legs are spaced apart at said second wall edge, and the height to width ratio is in the range of 1:1 to 1:4.

11. The wire formed product of claim 10, wherein said arcuate end has a radius and said radius and said base width are in a ratio of from about 1:2 to about 1:24.

12. The wire formed product of claim 11, wherein said arcuate end has a radius of from about ⅛" to about ½", said connecting wire has a cross-sectional dimension in the range of from about 1/16" to about ⅛", and said frame wire has a major cross-sectional dimension in the range of from about ⅙" to about ¼".

13. The wire formed product of claim 1, wherein said wall plane has one of a planar shape, an arcuate shape, a conical shape, a circular shape or a spherical zone shape.

14. A wire formed product comprising a weldment of one or more frame wires and connecting wires, said frame wire having a larger cross-sectional dimension than said connecting wire, said frame wire having a frame wire channel pattern including a U-shape cross-section with opposed frame legs joined by a frame bight, said connecting wires cooperating with said frame wire to provide sidewalls along said frame legs joined by a connecting wall along said frame bight, said sidewall including opposed first and second wall edges defining a sidewall plane, a plurality of said connecting wires forming arches that each include an arcuate end connecting spaced legs, said arcuate ends of said arches being welded to said frame wire at spaced locations along said first wall edge with said legs extending to said second wall edge, said arches being arranged in an array within said sidewall plane with adjacent legs overlapping at an intermediate point between said arcuate end and said second wall edge, said adjacent legs being welded together at said intermediate point.

15. The wire formed product of claim 14, wherein said spaced legs include terminal portions remote of said intermediate points, said terminal portions of said legs being bent at an angle to said sidewall plane to form said second wall edge as an integral wall edge, said terminal portions extending from said integral wall edge to form said connecting wall extending in a connecting wall plane that intersects said sidewall plane.

16. The wire formed product of claim 15, wherein said sidewall plane and connecting wall plane intersect at one of a right angle or an obtuse angle.

17. The wire formed product of claim 16, wherein said first mentioned frame wire and connecting wires cooperate to provide a first frame wire assembly, said wire formed product including a second frame wire having a frame wire channel pattern including a U-shape cross-section with opposed legs joined by a bight, said second frame wire and second connecting wires cooperating to form a second frame wire assembly including a U-shape cross-section with opposed legs joined by a bight, said second connecting wires cooperating with said frame wire to provide second sidewalls along said frame legs joined by a connecting wall along said bight of said second frame wire assembly, said first frame wire assembly being received cross-wise in said second frame wire assembly, said first mentioned sidewalls and said second sidewalls cooperating to form a chamber or container portion of said wire formed product.

18. The wire formed product of claim 17, wherein said second sidewall includes opposed first and second wall edges defining a second sidewall plane, a plurality of said second connecting wires forming arches that each include an arcuate end connecting spaced legs, said arcuate ends of said arches being welded to said second frame wire at spaced locations along said first wall edge with said legs extending to said second wall edge, said arches being arranged in an array within said second sidewall plane with adjacent legs overlapping at an intermediate point between said arcuate end and said second wall edge, said adjacent legs being welded together at said intermediate point.

19. The wire formed product of claim 18, wherein said second wall edge of said second sidewall is provided by said first frame wire.

20. The wire formed product of claim 14, wherein said arch shape is generally symmetrical about an axis extending between said legs and passing through a midpoint of said arcuate end, and said arcuate end has a radius of from about ⅛" to about ½", said connecting wire has a cross-sectional dimension in the range of from about 1/16" to about ⅛", and said frame wire has a major cross-sectional dimension in the range of from about ⅙" to about ¼".

21. The wire formed product of claim 14, wherein said arch has a height and a base width corresponding with the distance said connecting legs are spaced apart at said second wall edge, and the height to width ratio is in the range of 1:1 to 1:4, and said arcuate end has a radius and said radius and said base width are in a ratio of from about 1:2 to about 1:24.

* * * * *